US008469297B2

(12) United States Patent
Makino

(10) Patent No.: US 8,469,297 B2
(45) Date of Patent: Jun. 25, 2013

(54) AIRFLOW CLASSIFIER AND PARTICULATE MATERIAL PREPARING APPARATUS USING THE AIRFLOW CLASSIFIER

(75) Inventor: Nobuyasu Makino, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 247 days.

(21) Appl. No.: 13/090,638

(22) Filed: Apr. 20, 2011

(65) Prior Publication Data

US 2011/0259982 A1 Oct. 27, 2011

(30) Foreign Application Priority Data

Apr. 27, 2010 (JP) ..... 2010-101934

(51) Int. Cl.
*B02C 23/10* (2006.01)

(52) U.S. Cl.
USPC ..... 241/101.5; 241/79.1; 209/720

(58) Field of Classification Search
USPC ..... 241/79.1, 80, 101.5, 720, 721, 722, 241/723; 209/139.2, 141, 142, 154, 721
See application file for complete search history.

(56) References Cited

U.S. PATENT DOCUMENTS

| | | | | |
|---|---|---|---|---|
| 4,221,655 | A * | 9/1980 | Nakayama et al. | 209/135 |
| 6,260,708 | B1 * | 7/2001 | Adam et al. | 209/139.2 |
| 6,568,536 | B2 * | 5/2003 | Tanaka et al. | 209/139.2 |
| 7,032,849 | B2 | 4/2006 | Takahashi et al. | |
| 7,156,331 | B2 | 1/2007 | Takahashi et al. | |
| 7,364,101 | B2 | 4/2008 | Tanaka et al. | |
| 7,438,245 | B2 | 10/2008 | Kawamoto et al. | |
| 2006/0214036 | A1 | 9/2006 | Makino | |
| 2009/0206008 | A1 | 8/2009 | Makino et al. | |
| 2010/0170973 | A1 | 7/2010 | Makino et al. | |
| 2011/0089085 | A1 * | 4/2011 | Tamura et al. | 209/7 |

FOREIGN PATENT DOCUMENTS

| | | |
|---|---|---|
| JP | 3302270 | 4/2002 |
| JP | 2006-55838 | 3/2006 |
| JP | 2008-284420 | 11/2008 |
| JP | 2009-189980 | 8/2009 |

* cited by examiner

*Primary Examiner* — Dana Ross
*Assistant Examiner* — Leonel Vasquez
(74) *Attorney, Agent, or Firm* — Cooper & Dunham LLP

(57) ABSTRACT

The airflow classifier includes a dispersing chamber dispersing a powdery raw material with high pressure air; a classifying chamber located below the dispersing chamber and including a center core located on an upper portion thereof and a separator core having an opening at a center thereof and located on a lower portion of the classifying chamber to subject the raw material, which is fed from the dispersing chamber, to centrifugal classification to classify the raw material into coarse particles and fine particles; a fine particle feeding pipe connected with a lower portion of the opening of the separator core; a shield ring to cover an upper portion of the opening; and a louver pipe which is located above the shield ring and in which plural blades are arranged on an edge of the opening at predetermined intervals.

12 Claims, 6 Drawing Sheets

AIRFLOW CLASSIFIER AND PARTICULATE MATERIAL PREPARING APPARATUS USING THE AIRFLOW CLASSIFIER

BACKGROUND

1. Technical Field

This disclosure relates to an airflow classifier to perform a classification operation on a particulate material, and to a particulate material preparing apparatus to prepare a particulate material having a desired particle size using the airflow classifier.

2. Discussion of the Related Art

There are particulate material preparing apparatuses including a pulverization and coarse particle classification device and a fine particle classification device. Conventional pulverization and coarse particle classification devices typically include two sets of one pulverizer and one classifier connected with the pulverizer, or a combination of one pulverizer and two classifiers. Specific examples of the pulverizer include jet mills in which a particulate raw material is fed into jet airflow spouted from a jet nozzle so that particles of the raw material collide against each other or a collision material (such as collision plates and walls), resulting in pulverization of the raw material; and mechanical pulverizers in which a particulate raw material is fed to a gap between a rotor having convexes and concaves on the surface thereof and a stator also having convexes and concaves so that the raw material is collided against the rotor and stator by swirling airflow caused by the rotor and stator. After the raw material is pulverized by one or two of such pulverizers, the pulverized material is classified with a combination of two coarse particle classifiers. The particulate material from which coarse particles are removed (i.e., relatively fine particles) are then subjected to fine particle classification using a fine particle classification device in which two classifiers are typically connected.

FIG. 1 is a schematic view illustrating a conventional particulate material preparing apparatus.

As illustrated on the left side of FIG. 1, a pulverization and coarse particle classification process is performed in a closed circuit. Specifically, a raw material is fed to a pulverizer 82 through a supply tube 81 to be pulverized. The pulverized raw material is collected once by a cyclone 84, and then fed to a coarse particle classifier 85 to be classified into relatively fine particles and relatively coarse particles to be pulverized again. The coarse particles are returned to the pulverizer 82 through a pipe 83 to be pulverized. The fine particles are fed to a cyclone 87 through a passage 86 to be collected.

In the coarse particle classification process, the particulate material fed to the classifier 85 is the pulverized raw material (i.e., the particulate material in the process of pulverization), and therefore the particulate material circulating in the circuit has a broad particle diameter distribution. When a product (particulate materials such as toner) having a desired particle diameter distribution is obtained from the particulate material, the yield of the product is very low, and the apparatus has to be operated with a heavy load because the amount of the particulate material returned to the pulverizer is large.

The fine particles collected by the cyclone 87 are subjected to a fine particle classification process. Specifically, the fine particles are then fed to a fine particle classifier 88 to be further classified, and particles having particle diameters in a desired particle diameter range are collected as a product in a product container 89.

The fine particles thus obtained in the fine particle classification process are collected by a cyclone 91 through a passage 90, and then fed to a fine particle classifier 94 through a passage 92 to be further classified. In this case, the relatively large particles are returned to the classifier 88 through a passage 93 while relatively fine particles are fed to a cyclone 96 through a passage 95 to be collected, and the collected fine particles are then fed to a container 97. A one-step or two-step classifier can be used for each of the fine particle classifiers 88 and 94 with consideration of the processing ability thereof.

In this system, a mixture of particles of the raw material and particles in process of pulverization, whose particle diameters fall in a wide particle diameter range, is circulated between a pulverizer and a classifier, and therefore the mixture has a very broad particle diameter distribution. Therefore, in order to prepare a product having a particle diameter in a desired particle diameter range, the system has to be operated with a heavy load. Accordingly, the resultant product tends to include a large amount of undesired coarse particles deteriorating image qualities. Meanwhile, relatively coarse particles returned to the pulverizer to be pulverized again include a large amount of relatively fine particles, which need not be further pulverized. Since such relatively fine particles are also pulverized by the pulverizer, the amount of finer particles included in the resultant pulverized particles increases, and in addition a problem in that the finer particles aggregate is also caused. Therefore, when the thus pulverized particles are classified in the following classification process to obtain a product, the yield of the product is low.

Since a toner prepared by such a conventional particulate material preparing apparatus includes large amounts of coarse particles and fine particles, the particles of the toner have a wide range of charge quantities, resulting in variation of the image density of images produced by the toner. In addition, excessively pulverized toner particles cause a background development problem in that the background area of an image is soiled with the toner particles, and coarse toner particles, which are not sufficiently pulverized, cause an insufficient transfer problem in that the toner particles are not transferred to an image area of an image bearing member, resulting in formation of an image having omissions. In addition, since a heavy load is applied on the classifiers of the particulate material preparing apparatus as mentioned above, the apparatus has low classification efficiency while having low pulverization energy efficiency in the pulverization process.

Recent image forming apparatuses typically form digital images using toner and are required to produce high quality images. Therefore, toner used for such image forming apparatuses is also required to have a sharp particle diameter distribution while minimizing the amounts of coarse and fine particles. Since conventional pulverizers consume much energy for a fine pulverization process, the pulverizers are not economically preferable for producing such toner. In addition, since jet air pulverizers produce toner including coarse particles in a relatively large amount of from 1% to 15% by weight, it is necessary to remove such coarse particles, resulting in deterioration of production efficiency. Alternatively, it is necessary to further perform a pulverization operation. In this case, the energy consumption is increased. Further, since the above-mentioned conventional pulverization/classification apparatuses have insufficient pulverization properties such as pulverization processing ability and energy consumption, the toner produced by the apparatuses has broad particle diameter distribution and broad charge quantity distribution, and therefore it is difficult for the toner to produce high quality images.

In attempting to efficiently produce a particulate material having a sharp particle diameter distribution while minimizing the amount of fine particles and coarse particles, airflow classifiers including a dispersing chamber and a classification chamber have been proposed. However, it is necessary for such airflow classifiers to improve the coarse particle classification accuracy.

Because of these reasons, the inventor recognized that there is a need for a particulate material preparing apparatus which can produce a particulate material having a desired particle diameter distribution (such as volume average particle diameter of not greater than 5 μm) while minimizing the amount of fine particles and coarse particles.

SUMMARY

As an aspect of this disclosure, an airflow classifier is provided which includes a dispersing chamber to disperse a powdery raw material with high pressure air; a classifying chamber which is located below the dispersing chamber and which includes a center core and a separator core having an opening at a center thereof on upper and lower sides of the classifying chamber, respectively, to subject the powdery raw material, which is fed from the dispersing chamber, to centrifugal classification to separate the powdery raw material into relatively coarse particles and relatively fine particles; a fine particle feeding pipe connected with a lower portion of the opening of the separator core to feed the fine particles; a shield ring covering an upper portion of the opening of the separator core to prevent the coarse particles from entering into the opening; and a louver pipe which is located above the shield ring and in which plural blades are circularly arranged on an edge of the opening of the separator core at predetermined intervals to prevent the coarse particles from entering into the opening.

As another aspect of this disclosure, a particulate material preparing apparatus is provided which includes a pulverization and coarse particle classification device including at least one pulverizer selected from the group consisting of mechanical pulverizers and airflow pulverizers to pulverize a raw material; and at least one classifier, which is the airflow classifier mentioned above and which is connected with the pulverizer to classify the pulverized raw material into relatively coarse particles and relatively fine particles. The particulate material preparing apparatus can further include a fine particle classification device to classify the relatively fine particles into relatively coarse particles and relatively fine particles.

The aforementioned and other aspects, features and advantages will become apparent upon consideration of the following description of the preferred embodiments taken in conjunction with the accompanying drawings.

DESCRIPTION OF THE PREFERRED EMBODIMENTS

The airflow classifier of this disclosure will be described by reference to drawings.

Figure 2:
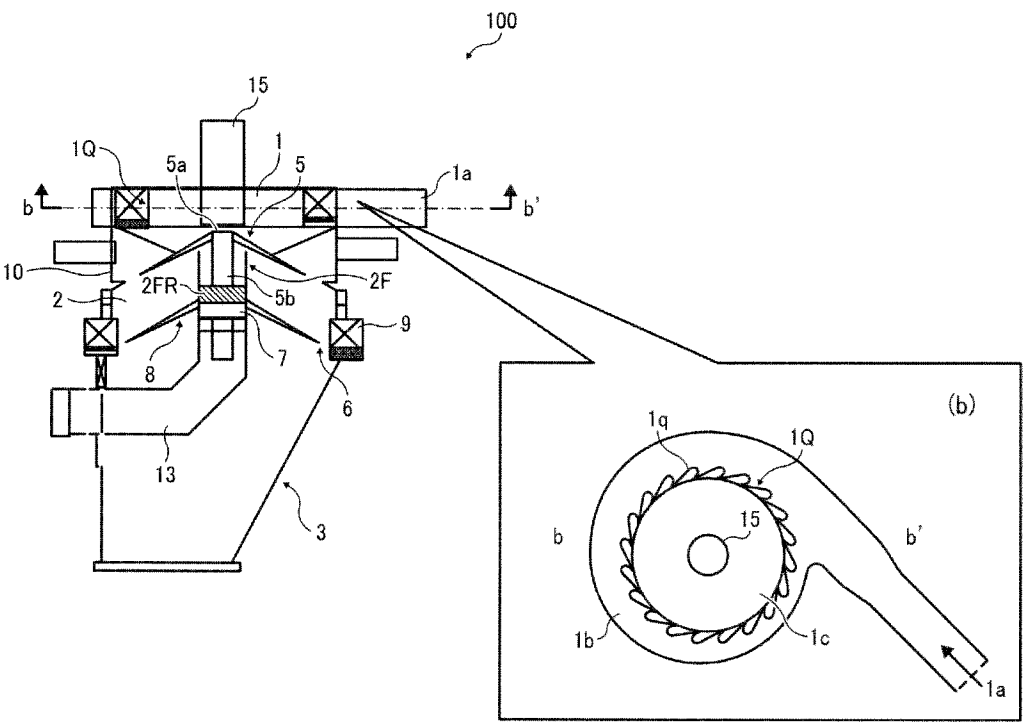
FIG. 2 is a schematic view illustrating an example of the airflow classifier of this disclosure.

FIG. 2(*a*) is a schematic cross-sectional view illustrating an example of the airflow classifier of this disclosure, and FIG. 2(*b*) is a cross-sectional view of the airflow classifier illustrated in FIG. 2(*a*) along a line b-b'.

Referring to FIG. 2(*a*), an airflow classifier 100 has a casing 10 having a feed opening 1*a*, which is located on an upper portion thereof and from which high pressure air and a powdery material including a raw material and a pulverized raw material. In the casing 10, an umbrella-form center core 5, an umbrella-form separator core 8 having an opening 7 at the center thereof, a dispersing chamber 1, which is surrounded by an upper wall of the casing 10 and the center core 5 and which disperses the high pressure air and the powdery material fed into the dispersing chamber, a classifying chamber 2, which is surrounded by the center core 5, the separator core 8 and an inner wall of the casing 10 and which subjects the powdery material fed from the dispersing chamber 1 to centrifugal classification to classify the powdery material into relatively fine particles and relatively coarse particles, and a lower hopper 3 are provided in descending order.

In the dispersing chamber 1, a louver ring 1Q having plural blades 1*q* circularly arranged at regular intervals, a space 1*b*, which is located along the peripheral surface of the louver ring 1Q and which serves as a flow path, along which the high pressure air and the powdery material fed from the feed opening 1*a* are fed, are provided as illustrated in FIG. 2(*b*). The interval between two adjacent blades 1*q* is preferably from 1 mm to 15 mm.

By providing the louver ring 1Q in the dispersing chamber 1, the mixture of high pressure air and the powdery material (i.e., powder fluid) fed from the feed opening 1*a* circulates around the entire peripheral surface of the louver ring 1Q while passing through the space 1*b*, and is fed into an inner portion 1*c* of the dispersing chamber 1 through spaces formed between the blades 1*q*. Thus, the powder fluid is uniformly fed into the inside of the louver ring 1Q (i.e., the inner portion 1*c* of the dispersing chamber 1), and thereby dispersing of the powdery material in the dispersing chamber 1 can be further improved.

The center core 5 has a fine particle exit 5*a* at the center thereof, and a second fine particle feeding pipe 5*b* extending from the fine particle exit 5*a* to the opening 7 of the separator core 8. Therefore, the powdery material fed into the inside of the dispersing chamber 1 through the louver ring 1Q forms swirling flow in the dispersing chamber 1 while being accelerated by suction of the second fine particle feeding pipe 5*b*, resulting in improvement of the dispersibility of the powdery material. At the same time, the finely pulverized material included in the powdery material are fed as fine particles through the fine particle exit 5*a*, the fine particle feeding pipe 5*b*, the opening 7 of the separator core 8, and a first fine particle feeding pipe 13 connected with the lower side of the opening 7.

A pinnate secondary air entrance 9 (i.e., a classification louver), through which air is fed to form secondary airflow (semi-free vortex flow), is provided on the peripheral wall of the classification chamber 2 to disperse the powdery material in the classification chamber while accelerating the powdery material. Therefore, fine particles in the classification chamber 2 are guided to the opening 7 of the separator core 8 by the airflow, and fed through the first fine particle feeding pipe 13 by suction of a blower. In addition, when coarse particles (having a particle diameter of not less than about 8 μm) are swirled on the separator core 8, the coarse particles are fed to a circular coarse particle exit 6, which is located between the separator core 8 and the secondary air entrance 9 and which is located around the lower edge of the separator core 8, by the centrifugal force of the airflow, and the coarse particles passing the circular coarse particle exit 6 then fall into the lower hopper 3 by gravity. The coarse particles in the hopper 3 are returned to the supply tube 81 through the pipe 83.

Figure 3:
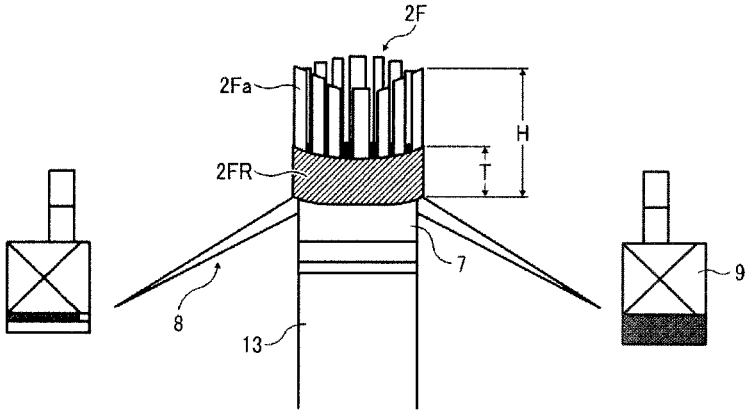
FIG. 3 is a schematic view illustrating an opening of a separator core of the airflow classifier illustrated in FIG. 2.

As illustrated in FIG. 3, plural blades 2Fa are circularly arranged at regular intervals along the upper end of the opening 7 to form a louver pipe 2F. The louver pipe 2F passes the airflow fed from the classification chamber 2 into the opening 7, but prevents coarse particles included in the fine particles in the classification chamber 2 from passing therethrough by bouncing the coarse particles using the plural blades 2Fa. In this regard, it is preferable that the louver pipe 2F extends from the separator core 8 to the vicinity of the lower surface of the center core 5 so as to cover the entire of the central portion of the classification chamber 2.

In addition, a shield ring 2FR is provided on the upper end of the opening 7 to block or bounce coarse particles moving up to the shield ring along the upper surface of the separator core 8 so that the coarse particles are not fed into the opening 7. The shield ring 2FR is made of an electroconductive material, and is fixed to the separator core 8 similarly to the louver pipe 2F.

As illustrated in FIG. 3, the shield ring 2FR is set on the peripheral surface of a lower portion of the louver pipe 2F, which portion faces the opening 7, so as to cover the lower portion and to shield the spaces formed between the plural blades 2Fa. Alternatively, it is possible that the shield ring 2FR is initially set on the opening 7, and then the louver pipe 2F is set on the upper end of the shield ring.

In this regard, the following relationship is preferably satisfied:

$$H/5 \leqq T \leqq 3H/5,$$

wherein T represents the height of the shield ring 2FR, and H represents the height of the louver pipe 2F.

Figure 4:
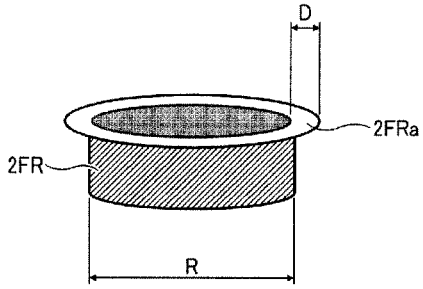
FIG. 4 is a perspective view illustrating a shield ring of the airflow classifier illustrated in FIG. 2.

As illustrated in FIG. 4, the upper portion of the shield ring 2FR preferably has a flange 2FRa extending outward so that coarse particles moving up along the upper surface of the separator core 8 and the outer surface of the shield ring 2FR are reversed by the flange 2FRa so as to be fed to the coarse particle exit 6 located on the outside of the separator core 8, resulting in falling in the lower hopper 3. Thus, the flange 2FRa efficiently prevents coarse particles from being mixed with fine particles.

In this regard, the flange 2FRa preferably has a width D of from R/20 to 5R/20, wherein R represents the diameter of the shield ring 2FR as illustrated in FIG. 4. By adjusting the width D of the flange 2FRa, it becomes possible to control the volume average particle diameter of the product in the classification process and the content of coarse particles included in the product. It is possible for the shield ring 2FR to have such configuration as to freely change the width D of the flange 2FRa thereof depending on the classifier used.

Referring back to FIG. 2, the dispersing chamber 1 has an air discharging pipe 15, which is located at the center of an upper portion thereof and which extends from the dispersing chamber to the outside. The air discharging pipe 15 preferably has an inner diameter A of from B/2 to 3B, wherein B represents the inner diameter of the fine particle exit 5*a*. By thus adjusting the inner diameter A of the air discharging pipe 15, the particles of the powdery material to be classified are swirled in different manners based on the volume average particle diameter thereof while the solid-air separation operation can be accelerated. In addition, among the particles swirling in the dispersing chamber 1, super fine particles are swirled at the center of the dispersing chamber, and thereby the super fine particles are prevented from being discharged from the air discharging pipe 15.

Figure 5:
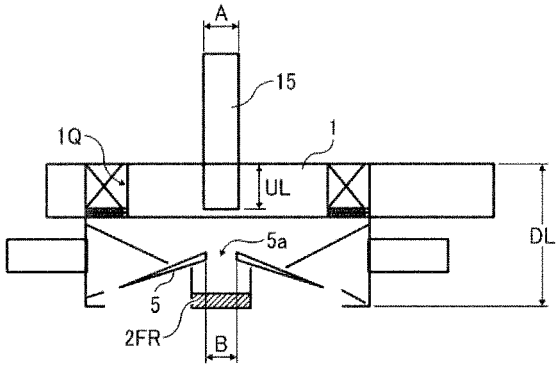
FIG. 5 is a schematic view illustrating a dispersing chamber of the airflow classifier illustrated in FIG. 2.

As illustrated in FIG. 5, a length UL of a portion of the air discharging pipe 15 located within the dispersing chamber 1 is preferably from DL/5 to 3DL/5, wherein DL represents the height of the dispersing chamber 1. By thus adjusting the length A of the portion of the air discharging pipe 15 located within the dispersing chamber 1, the particles of the powdery material to be classified are swirled in different manners based on the volume average particle diameter thereof while the solid-air separation operation can be accelerated. In addition, among the particles swirling in the dispersing chamber 1, super fine particles are swirled at the center of the dispersing chamber, and thereby the super fine particles are prevented from being discharged from the air discharging pipe 15.

Next, the particulate material preparing apparatus of this disclosure will be described.

Figure 1:
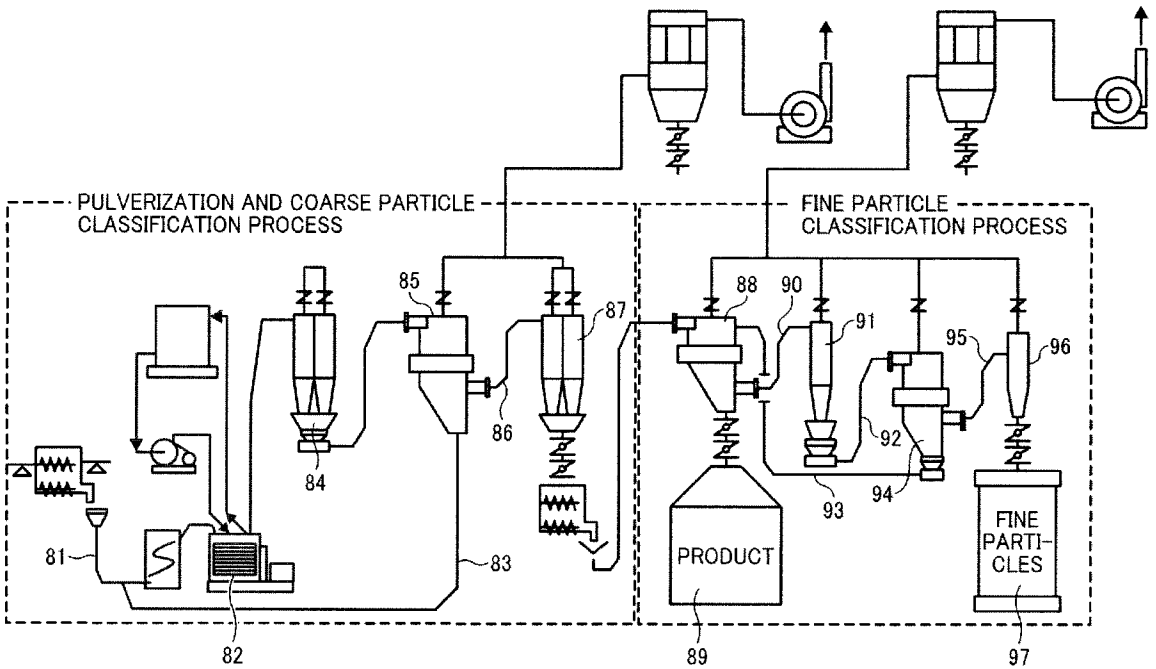
FIG. 1 RELATED ART
FIG. 1 is a schematic view illustrating a conventional particulate material preparing apparatus.

The particulate material preparing apparatus has a configuration similar to that illustrated in FIG. 1 except that the above-mentioned airflow classifier 100 is used for the pulverization and coarse particle classification process. Specifically, the particulate material preparing apparatus of this disclosure includes a pulverization and coarse particle classification device including a combination of one or more mechanical or airflow pulverizers and one or more of the airflow classifier 100 mentioned above.

Figure 6:
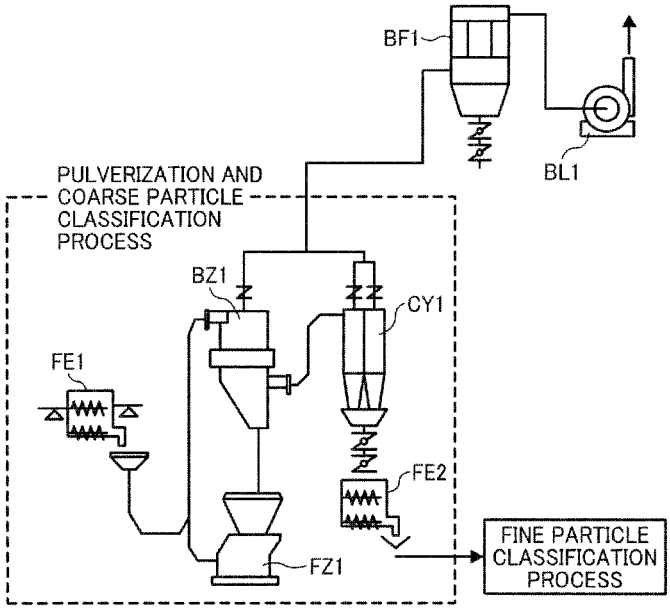
FIG. 6 is a schematic view illustrating an example of the pulverization and coarse particle classification device of the particulate material preparing apparatus of this disclosure.
Figure 7:
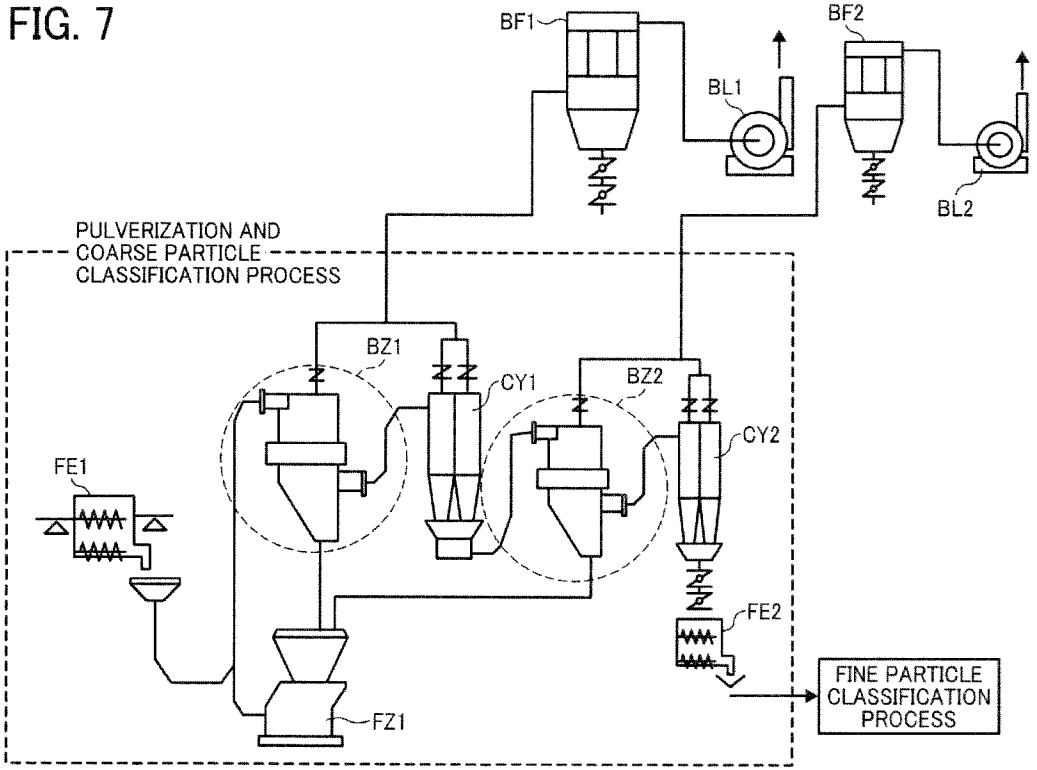
FIG. 7 is a schematic view illustrating another example of the pulverization and coarse particle classification device of the particulate material preparing apparatus of this disclosure.
Figure 8:
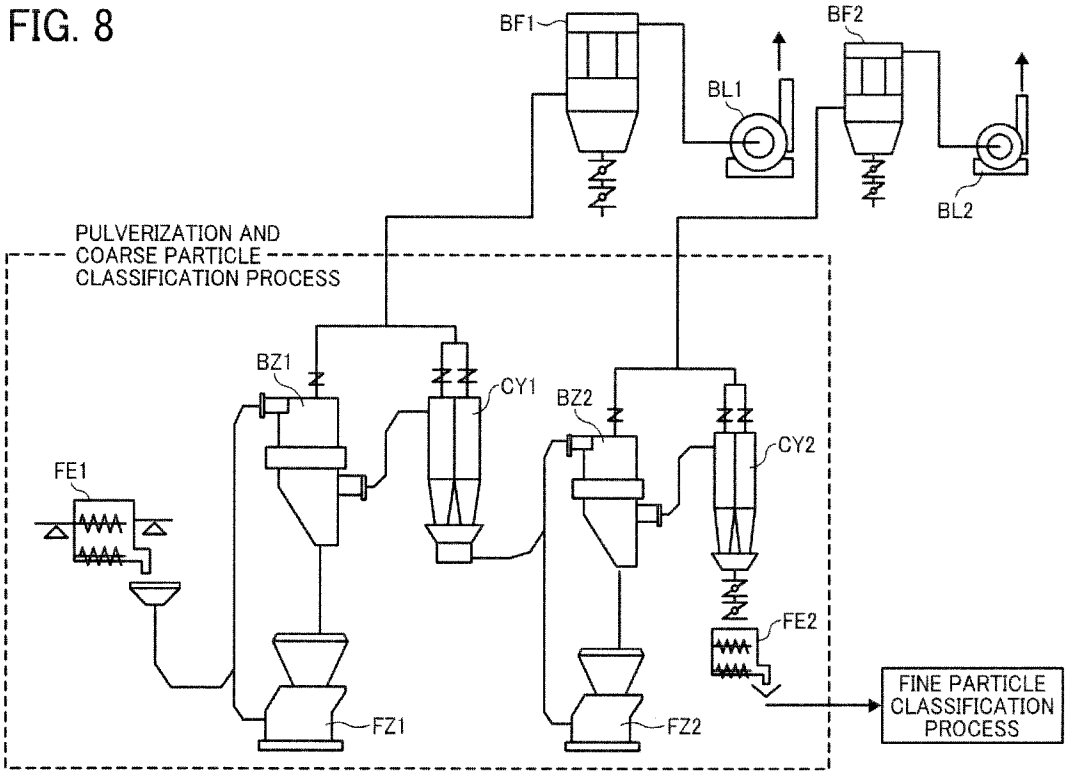
FIG. 8 is a schematic view illustrating yet another example of the pulverization and coarse particle classification device of the particulate material preparing apparatus of this disclosure.

FIGS. 6-8 illustrate examples of configuration of the pulverization and coarse particle classification device of the particulate material preparing apparatus of this disclosure. Specifically, the pulverization and coarse particle classification device illustrated in FIG. 6 includes a combination of one airflow classifier BZ1, which is the above-mentioned airflow classifier 100, and one pulverizer FZ1. The pulverization and coarse particle classification device illustrated in FIG. 7 includes a combination of two airflow classifiers BZ1 and BZ2, each of which is the above-mentioned airflow classifier 100, and one pulverizer FZ1. The pulverization and coarse particle classification device illustrated in FIG. 8 includes a combination of two airflow classifiers BZ1 and BZ2, each of which is the above-mentioned airflow classifier 100, and two pulverizers FZ1 and FZ2.

Since the functions of the airflow classifiers BZ1 and BZ2 are the same as each other and the functions of the pulverizers FZ1 and FZ2 illustrated in FIGS. 6-8 are the same as each other, only the pulverization and coarse particle classification device illustrated in FIG. 8 will be described.

Referring to FIG. 8, a raw material is supplied through a feed pipe FE1, and is fed to the first classifier BZ1 (which is the airflow classifier 100 mentioned above) together with the pulverized material, which is fed from the first pulverizer FZ1, and high pressure air by a blower BL1. The first classifier BZ1 classifies the raw material and the pulverized material into relatively fine particles and relatively coarse particles. The coarse particles are then pulverized by the first pulverizer FZ1, and the pulverized material is fed again to the first classifier BZ1. By contrast, the fine particles are collected once by a cyclone CY1, and then fed to the second classifier BZ2 (which is the airflow classifier 100 mentioned above) by a blower BL2 together with high pressure air to be classified into relatively fine particles and relatively coarse particles. The relatively coarse particles are then pulverized by the second pulverizer FZ2, and the pulverized material is fed again to the second classifier BZ2. By contrast, the relatively fine particles are collected by a cyclone CY2, and then subjected to the following fine particle classification process through a feeding pipe FE2 to be classified into fine particles and a product. The fine particle classification process is performed by the fine particle classification device illustrated on the right side of FIG. 1. In FIG. 8, reference characters BF1 and BF2 denote bag filters.

Thus, the fine particles obtained by the classification operation of the first classifier BZ1 is further classified by the second classifier BZ2, and therefore the resultant fine particles have a sharp particle diameter distribution. In addition, by serially connecting two or more combinations of a classifier and a pulverizer, a product having a relatively small average particle diameter can be produced with minimal change of the device and/or the production capacity can be increased.

In this system, the powdery material fed to the classifier includes not only the raw material but also the pulverized material, namely, particles having a variety of particle diameters are circulated in a closed circuit including the pulverizer and the classifier.

The pulverizer used for the pulverization and coarse particle classification device is a mechanical or airflow pulverizer. Specific examples of the pulverizer include jet air pulverizers in which high pressure air emitted from a jet nozzle catches a raw material therein so that the particles of the raw material strike each other or a collision wall, plate or the like, resulting in pulverization of the raw material. Specific examples of the commercial pulverizers include I type mill from Nippon Pneumatic Mfg. Co., Ltd.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following toner components were mixed.

| | |
|---|---|
| Polyester resin | 75 parts |
| Styrene-acrylic copolymer | 10 parts |
| Carbon black | 15 parts |

The mixture was subjected to melt kneading using a roll mill, and then cooled to solidify the kneaded toner component mixture. The kneaded toner component mixture was then crushed by a hammer mill. The crushed toner component mixture was then pulverized and classified by a particulate material preparing apparatus using the pulverization and coarse particle classification device illustrated in FIG. 7 at a raw material feeding rate of 200 kg/hr. Thus, fine colored particles (i.e., a toner) were prepared.

In this regard, the specifications of the pulverization and coarse particle classification device used are as follows.

(1) First and second classifiers BZ1 and BZ2: The airflow classifier illustrated in FIG. 2 was used therefor.

(2) Height T of shield ring 2FR: 0.8H/5 (mm) (H represents the height (mm) of the louver pipe 2F)

(3) Inner diameter A of air discharging pipe 15: B/3 (B represents the inner diameter (mm) of the fine particle exit 5*a*)

(4) Length UL of portion of air discharging pipe 15 within dispersing chamber 1: 3.5DL/5 (DL represents the height (mm) of the dispersing chamber 1)

As a result of analysis of the particle diameter properties of the toner using a particle analyzer MULTISIZER from Beckman Coulter Inc., it was confirmed that the toner of Example 1 has a weight average particle diameter of 5.0 μm, and includes fine particles having a particle diameter of not greater than 4 μm in an amount of 90% by quantity while including coarse particles having a particle diameter of not less than 8 μm in an amount of 1.5% by volume. The yield of the toner was 97%.

Comparative Example 1

The procedure for preparation and evaluation of the toner in Example 1 was repeated except that the shield ring 2FR was not used.

As a result, it was confirmed that the toner of Comparative Example 1 has a weight average particle diameter of 5.1 μm, and includes fine particles having a particle diameter of not greater than 4 μm in an amount of 92% by quantity while including coarse particles having a particle diameter of not less than 8 μm in an amount of 2.5% by volume. The yield of the toner was 80%.

Example 2

The procedure for preparation and evaluation of the toner in Example 1 was repeated except that the height (T) of the shield ring 2FR was changed to 2H/5.

As a result, it was confirmed that the toner of Example 2 has a weight average particle diameter of 5.0 μm, and includes fine particles having a particle diameter of not greater than 4 μm in an amount of 90% by quantity while including coarse particles having a particle diameter of not less than 8 μm in an amount of 1.0% by volume. The yield of the toner was 97%.

Example 3

The procedure for preparation and evaluation of the toner in Example 2 was repeated except that the shield ring was replaced with the shield ring 2FR illustrated in FIG. 4, whose flange 2FRa has a width D (mm) of 5.5R/20 (R represents the diameter (mm) of the shield ring).

As a result, it was confirmed that the toner of Example 3 has a weight average particle diameter of 4.9 μm, and includes fine particles having a particle diameter of not greater than 4 μm in an amount of 88% by quantity while including coarse particles having a particle diameter of not less than 8 μm in an amount of 0.9% by volume. The yield of the toner was 97%.

Example 4

The procedure for preparation and evaluation of the toner in Example 3 was repeated except that the width D of the flange 2FRa was changed to 3R/20 (R represents the diameter of the shield ring).

As a result, it was confirmed that the toner of Example 4 has a weight average particle diameter of 4.9 μm, and includes fine particles having a particle diameter of not greater than 4 μm in an amount of 85% by quantity while including coarse particles having a particle diameter of not less than 8 μm in an amount of 0.8% by volume. The yield of the toner was 98%.

Example 5

The procedure for preparation and evaluation of the toner in Example 4 was repeated except that the inner diameter A of the air discharging pipe 15 was changed to 3B/2.

As a result, it was confirmed that the toner of Example 5 has a weight average particle diameter of 4.8 μm, and includes fine particles having a particle diameter of not greater than 4 μm in an amount of 85% by quantity while including coarse particles having a particle diameter of not less than 8 μm in an amount of 0.6% by volume. The yield of the toner was 98%.

Example 6

The procedure for preparation and evaluation of the toner in Example 5 was repeated except that the length UL of the air discharging pipe 15 in the dispersing chamber 1 was changed to 2DL/5.

As a result, it was confirmed that the toner of Example 6 has a weight average particle diameter of 4.8 μm, and includes fine particles having a particle diameter of not greater than 4 μm in an amount of 85% by quantity while including coarse particles having a particle diameter of not less than 8 μm in an amount of 0.4% by volume. The yield of the toner was 98%.

In addition, it was confirmed that each of the toners prepared in Examples 1-6 has a sharp particle diameter distribution and a good charge quantity stability, and images formed by using these toners have good image qualities without defective images such as background development and omissions caused by defective image transferring.

As mentioned above, the airflow classifier of this disclosure has a shield ring and a louver pipe, and therefore inclusion of excessively coarse particles in the product can be prevented. Therefore, the airflow classifier has better classification accuracy than conventional classifiers.

In addition, since the particulate material preparing apparatus of this disclosure is equipped with the airflow classifier, a particulate material consisting essentially of fine particles having a sharp particle diameter distribution can be prepared. Since coarse particles obtained in a classification process are pulverized again by a pulverizer to be used for the product, material saving and energy saving can be made. The particulate material preparing apparatus of this disclosure is preferably used for preparing toner.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-101934, filed on Apr. 27, 2010, the entire contents of which are herein incorporated by reference.

What is claimed is:

1. An airflow classifier comprising:

a dispersing chamber to disperse a powdery raw material with high pressure air;

a classifying chamber located below the dispersing chamber and including:

a center core located on an upper portion of the classifying chamber; and a separator core having an opening at a center thereof and located on a lower portion of the classifying chamber to subject the powdery raw material, which is fed from the dispersing chamber, to centrifugal classification to classify the powdery raw material into relatively coarse particles and relatively fine particles;

a fine particle feeding pipe connected with a lower portion of the opening of the separator core to feed the relatively fine particles;

a shield ring covering an upper portion of the opening of the separator core; and a louver pipe which is located above the shield ring and in which plural blades are arranged on an edge of the opening of the separator core at predetermined intervals.

2. The airflow classifier according to claim 1, wherein the shield ring has a height T of from H/5 to 3H/5, wherein H represents a height of the louver pipe.

3. The airflow classifier according to claim 1, wherein the shield ring has a flange extending outward circularly from an upper portion thereof.

4. The airflow classifier according to claim 3, wherein the flange has a width D of from R/20 to 5R/20, wherein R represents a diameter of the shield ring.

5. The airflow classifier according to claim 1, wherein the center core includes:

a fine particle exit located at a center thereof; and a second fine particle feeding pipe connected with the fine particle exit and extending from the fine particle exit to the opening of the separator core.

6. The airflow classifier according to claim 5, wherein the dispersing chamber includes:

an air discharging pipe located at a center of an upper portion of the dispersing chamber and extending from inside of the dispersing chamber to outside, wherein the air discharging pipe has an inner diameter A of from B/2 to 3B, wherein B represents an inner diameter of the fine particle exit.

7. The airflow classifier according to claim 5, wherein the dispersing chamber includes:

an air discharging pipe located at a center of an upper portion of the dispersing chamber and extending from inside of the dispersing chamber to outside, wherein a portion of the air discharging pipe located within the dispersing chamber has a length UL of from DL/5 to 3DL/5, wherein DL represents a height of the dispersing chamber.

8. A particulate material preparing apparatus comprising:

a pulverization and coarse particle classification device including:

at least one pulverizer selected from the group consisting of mechanical pulverizers and airflow pulverizers to pulverize a powdery raw material; and at least one airflow classifier connected with the pulverizer to classify the pulverized raw material into relatively coarse particles and relatively fine particles, wherein the at least one airflow classifier is the airflow classifier according to claim 1.

9. The particulate material preparing apparatus according to claim 8, wherein the pulverization and coarse particle classification device includes one pulverizer and one airflow classifier connected with the one pulverizer.

10. The particulate material preparing apparatus according to claim 8, wherein the pulverization and coarse particle classification device includes one pulverizer and two airflow classifiers each connected with the one pulverizer.

11. The particulate material preparing apparatus according to claim 8, wherein the pulverization and coarse particle classification device includes two pulverizers including first and second pulverizers, and two airflow classifiers including first and second classifiers, and wherein the first classifier is connected with the first pulverizer, and the second classifier is connected with the second pulverizer.

12. The particulate material preparing apparatus according to claim 8, further comprising:

a fine particle classification device to classify the relatively fine particles into relatively coarse particles and relatively fine particles.

* * * * *